US007740110B2

(12) United States Patent
Kattainen et al.

(10) Patent No.: US 7,740,110 B2
(45) Date of Patent: Jun. 22, 2010

(54) ELEVATOR BRAKE AND BRAKE CONTROL CIRCUIT

(75) Inventors: Ari Kattainen, Hyvinkää (FI); Timo Syrman, Hyvinkää (FI)

(73) Assignee: Kone Corporation, Helsinki (FI)

( * ) Notice: Subject to any disclaimer, the term of this patent is extended or adjusted under 35 U.S.C. 154(b) by 734 days.

(21) Appl. No.: 10/573,982

(22) PCT Filed: Nov. 10, 2004

(86) PCT No.: PCT/FI2004/000668

§ 371 (c)(1),
(2), (4) Date: Apr. 18, 2007

(87) PCT Pub. No.: WO2005/047157

PCT Pub. Date: May 26, 2005

(65) Prior Publication Data

US 2007/0272491 A1 Nov. 29, 2007

(30) Foreign Application Priority Data

Nov. 12, 2003 (FI) ..... 20031647

(51) Int. Cl.
*B66B 1/32* (2006.01)

(52) U.S. Cl. ..... 187/288; 187/305

(58) Field of Classification Search ..... 187/277, 187/286–289, 305, 358, 374
See application file for complete search history.

(56) References Cited

U.S. PATENT DOCUMENTS 3,842,329 A 10/1974 Mierendorf
4,030,007 A 6/1977 Price et al.
4,102,436 A * 7/1978 Kernick et al. ..... 187/293
4,116,306 A * 9/1978 Alley ..... 187/293
4,368,501 A 1/1983 Gingrich
4,982,815 A * 1/1991 Arabori et al. ..... 187/288
4,984,659 A * 1/1991 Nomura ..... 187/288
4,987,977 A * 1/1991 Nomura ..... 187/288
5,153,389 A * 10/1992 Nomura ..... 187/288
6,056,088 A 5/2000 Gerstenkorn

FOREIGN PATENT DOCUMENTS

EP 0 038 966 A1 11/1981
EP 1 067 081 A1 1/2001
JP 11-5675 A 1/1999
JP 2001-278554 A 4/2002

* cited by examiner

*Primary Examiner*—Jonathan Salata
(74) *Attorney, Agent, or Firm*—Birch, Stewart, Kolasch & Birch, LLP.

(57) ABSTRACT

A control circuit for controlling an electromechanical elevator brake is disclosed. The control circuit includes at least one brake coil (L1), a direct-voltage source (BR1), a semiconductor switch arrangement, a current measuring unit, at least two semiconductor switches, and a control unit (CO1) for controlling operation of the circuit. The current measuring unit (Lm1) produces current data that is passed to the control unit (CO1). The at least two semiconductor switches (SW1, SW2) are controlled by the control unit (CO1) such that operation is alternated between the two so that the working condition of each switch can be checked in its turn on the basis of feedback data obtained from the current measuring unit.

12 Claims, 4 Drawing Sheets

ELEVATOR BRAKE AND BRAKE CONTROL CIRCUIT

FIELD OF THE INVENTION

The present invention relates to an electromechanical brake and a circuit for controlling an electromechanical elevator brake.

BACKGROUND OF THE INVENTION

The operation of an electromechanical brake of an elevator is such that when the brake coil is currentless, the brake remains closed as a brake pad is pressed against a braking surface by the force generated by a mechanical pressure means, e.g. a spring. When a sufficient current is conducted to the brake coil, the force produced by the magnetic field thus set up acts in a direction opposite to the force transmitted from the pressure element to the brake pad and releases the brake, permitting rotation of the traction sheave and movement of the elevator. The brake coil current needed to release the brake, the so-called operating current, is larger than the holding current, which is needed to keep the brake in the released state after it has already been released. The brake is said to be in an energized state when released, and correspondingly in a de-energized state when the brake is closed. For operating safety, it is essential to have a possibility to get the brake into the de-energized state when necessary, which can be reliably implemented by interrupting the supply of current to the brake coil.

To control the supply of electricity to electromechanical elevator brakes, contactors connected to a direct-current circuit controlling the brake are generally used. A direct voltage is obtained e.g. by means of a rectifier from an alternating-current circuit. As the contactor works on the direct-current side, it has to be relatively large. Moreover, the contactor is a mechanical element subject to wear with time. To ensure that a failure of the contactor in the direct-current circuit will not lead to a dangerous situation, the brake is additionally controlled by contactors connected to the alternating-current side, which, however, is a relatively slow process. A prior-art brake works in such manner that when the elevator stops, the control unit of the elevator drive controls a switch on the direct-current side so as to cause the brake to start braking, whereupon the control unit removes the torque from the elevator motor. After that, the contactors on the alternating-current side are opened. If the control of the direct-current side does not work or the switch has been damaged, the elevator will bound when stopping, which involves a safety risk and gives the elevator passengers a feeling of inconvenience. In addition, the control system of the elevator drive receives no feedback information regarding brake control.

In some prior-art elevator brake control circuits the contactor in the direct-current circuit is replaced by a controlled semiconductor switch, such as a transistor. A control circuit of this type for controlling an electromagnetic brake is disclosed in specification JP 2001278554. It describes a control circuit which contains a direct-current circuit comprising a brake coil, a current measuring circuit in series with it and a transistor controlling the brake coil. The direct-current circuit receives a voltage via a rectifier from an alternating-current network. In this specification, the brake is controlled by comparing the brake coil current to a reference value and controlling the transistor using the comparison value thus obtained. This arrangement is designed to reduce the noise, losses and costs of the brake system. A drawback with the brake system according to the specification in question is that the brake circuit comprises only one transistor, which means that a failure of the transistor involves a safety risk. In addition, the working condition of the transistor cannot be checked.

SUMMARY OF THE INVENTION

The object of the present invention is to overcome the drawbacks of prior art and create an elevator brake that is more reliable than earlier brakes and a new type of elevator brake control circuit wherein a possible failure of the switches will be detected and whereby the brake can be reliably closed even in the event of failure of a switch.

The electromechanical elevator brake of the invention comprises at least a brake coil, a pressure element, a brake pad pressed towards a braking surface by the pressure element, said brake pad being movable by the force effects produced by the magnetic field generated by a current flowing in the brake coil, and a brake control circuit used to control the current supplied to the brake coil. In respect of its mechanical structures, the brake may be e.g. like the brake disclosed in specification EP1294632. The brake control circuit contains two semiconductor switches connected to a direct-voltage circuit, and the brake coil current can be completely switched off by a single functional semiconductor switch connected to the direct-voltage circuit regardless of the operative condition of the other switch.

The control circuit of the invention for controlling an electromechanical elevator brake contains at least one brake coil, a direct-current source, a semiconductor switch arrangement and a control unit as well as a current measuring unit producing current data, which can be input to the control unit. The number of semiconductor switches used is at least two, and these are controlled by the elevator drive control unit by measuring the current flowing in the direct-current circuit and monitoring the operation of the semiconductor switches. The current of each brake coil is controlled by two semiconductor switches. The switches can be controlled alternately by the control unit in such manner that the working condition of each switch can be checked in its turn by utilizing feedback data obtained from the current measurement. The brake can be reliably de-energized independently of the failure of a semiconductor switch in the direct-current circuit. The current state of the brake can be continuously determined by utilizing measurement data collected from the circuit.

The semiconductor switches in the brake control circuit can also be controlled and their condition monitored on the basis of the current measured from the alternating-current circuit feeding the direct-current circuit via the rectifier, and to allow more accurate determination of the state of the brake coil it is possible, if necessary, to separately supply the control unit with information regarding the voltage of the brake coil or the current flowing through it. The semiconductor switches can also be controlled by voltage supply, e.g. so that the switches are opened when the safety circuit is interrupted. Thus, the operation of the semiconductor switches can be controlled both via current measurement and via voltage supply. The use of two semiconductor switches per brake coil makes it possible to ensure the operation of the circuit in the case of failure of the semiconductor switches so that, in the control circuit of the invention, the supply of current to each brake coil can be completely interrupted by means of one semiconductor switch connected to the direct-current circuit after the other semiconductor switch controlling the brake has been damaged.

The details of the features of the control circuit of the invention are presented in the claims below.

In addition to what was stated above, the invention provides the following advantages:

- the control circuit is a non-wearing, simple and reliable circuit, and due to the use of semiconductor switches it is quieter than control circuits implemented using contactors
- a failure of the semiconductor switches of the control circuit can be detected very quickly, so the brake and its control circuit are reliable and safe to use
- using the information obtained from the current measurement, it is possible both to monitor the operation of the switches, to monitor the operation of the brake and to control the operation of the switches
- the condition of the brake can be determined and the brake adjusted more reliably on the basis of the current measurement data than on the basis of voltage data because the resistance of the brake coil changes as a function of temperature
- the closing of the brake can be implemented using two different speeds
- the control circuit can be compatible with existing control circuits
- the same control circuit can be used to control several brakes

BRIEF DESCRIPTION OF THE DRAWINGS

In the following, the invention will be described in detail with reference to examples and the attached drawings, wherein.

DETAILED DESCRIPTION OF THE INVENTION

Figure 1:
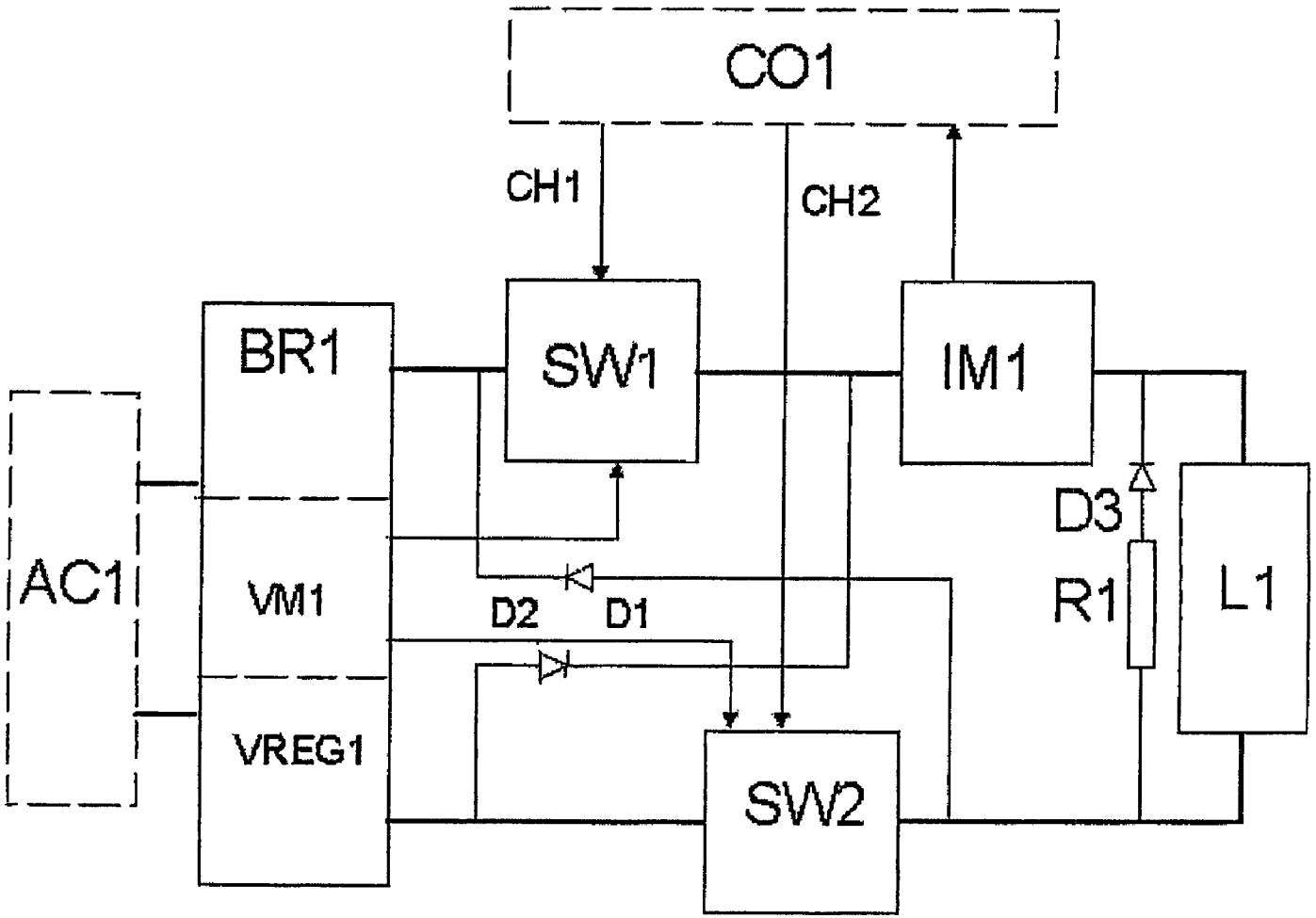
FIG. 1 presents a brake control circuit according to the invention for controlling the brake of an elevator

FIG. 1 represents a elevator brake control circuit, which contains a direct-current circuit comprising a brake coil L1, a rectifier bridge BR1 connected to an alternating-current network AC1, which may be e.g. a 230 V safety circuit, and semiconductor switches, e.g. IGBTs, SW1 and SW2, which are controlled by an elevator drive control unit CO1, each via a separate channel CH1 and CH2. In addition, the direct-current circuit comprises flywheel diodes D1 and D2, through which the current fed by the brake coil inductance flows when only one of the semiconductor switches is in the conducting state. In addition, the circuit comprises a series connection of a resistor R1 and a diode D3, which is connected in parallel with the brake coil L1 and through which the current generated by the large inductance of the coil L1 in a braking situation can be passed.

Moreover, the circuit comprises a direct current measuring unit IM1 producing current data, which is input to the drive control unit, as well as a voltage regulator VREG1 connected to the rectifier and a voltage measuring unit VM1 producing voltage data that can also be used to control the semiconductor switches.

The circuit presented in FIG. 1 works as follows. When the switches SW1 and SW2 are open, no current is flowing in the direct-current circuit and the brake is closed. This can be verified via the current measurement IM1. When the brake is to be opened, the switches SW1 and SW2 are closed. In the circuit of the invention, the supply of current from the DC supply BR1 to the brake coil is completely interrupted when one of the switches is open, and thus, before releasing the brake, the operating condition of the switches can be verified by alternately closing the switches for a moment and establishing via the current measuring unit that no current is flowing in the circuit. If the current measuring unit detects a current already after one (e.g. SW1) of the switches has been closed, then the other switch (SW2) has been damaged, and the elevator can be denied permission to depart.

After the brake has been released, it is kept in the energized state by supplying a hold current to the coil. The current to be fed to the coil is controlled by means of the switches SW1 and SW2 by alternately turning the switches off, so that when one of the switches is in the non-conducting state, the current flows via the flywheel diode D1 or D2. The current measurement data is used both to determine the actual value of the current supplied to the brake coil, on the basis of which the current state of the brake can be established, and to verify that the switches are working according to control. Thus, condition monitoring of the switches is a continuous process, and the operating condition of the switches can be checked on the basis of the current measurement data both when the brake is in the released state and when it is in the closed state.

When the elevator is to stop, the brake is closed either by a fast control routine by opening the switches SW1 and SW2 simultaneously, causing the energy stored in the coil inductance to be consumed in the resistor R3 and the brake coil current to fall rapidly, or by a slower control routine, causing the brake coil current to fall more slowly. In this case, first one switch, e.g. switch SW1 is opened, with the result that the energy stored in the coil inductance causes the current to flow by the route L1-SW2-D2-IM1-L1. Next, switch SW2 is also turned off, whereupon the current flows by the route L1-R1-D3-L1. By using the slow control routine, the mechanical noise of the brake can be reduced to a lower level than when the fast control routine is used. Interruption of the current is again established via current measurement. After this, the torque can be removed from the motor by the control unit CO1.

Besides using control commands transmitted via the channels CH1 and CH2, the switches SW1 and SW2 can be controlled by a supply produced by the voltage measuring unit VM1. Voltage control may work e.g. in such manner that the switches are opened every time when the voltage reaches too low a value, e.g. due to a disturbance in the electricity supply or an interruption of the safety circuit.

Alternatively, the circuit can be used in such manner that the current to be fed to the brake coil is regulated by setting the supply voltage by means of the voltage regulator VREG1 to a value corresponding to the desired state of the brake. The working condition of the switches can now be tested by turns in connection with the closing and releasing of the brake. For example, when the elevator is to stop, after the first switch, e.g SW1 has been opened, the current measurement IM1 indicates that the current starts to fall. The current is interrupted completely when switch SW2 is opened as well. In the following braking situation again, switch SW2 is sent a control signal first and only then switch SW1, in other words, during each successive control cycle the functionality of each switch can be tested alternately by using current feedback data. In this case, too, the braking can be performed at two different speeds: in a normal situation at a slow speed, producing a low mechanical noise, and in a failure situation at a high speed. The switches can be normally controlled by the slow stopping procedure, but if the safety circuit on the alternating-current side is open, in which case no voltage data is received from the voltage measuring unit, then the braking is performed by the fast procedure.

If one of the semiconductor switches fails, the circuit will go on working normally so that the brake coil current can be interrupted completely, but because one of the switches is disengaged, the negative voltage pulse produced when the current is switched off by both switches is left out.

Figure 2:
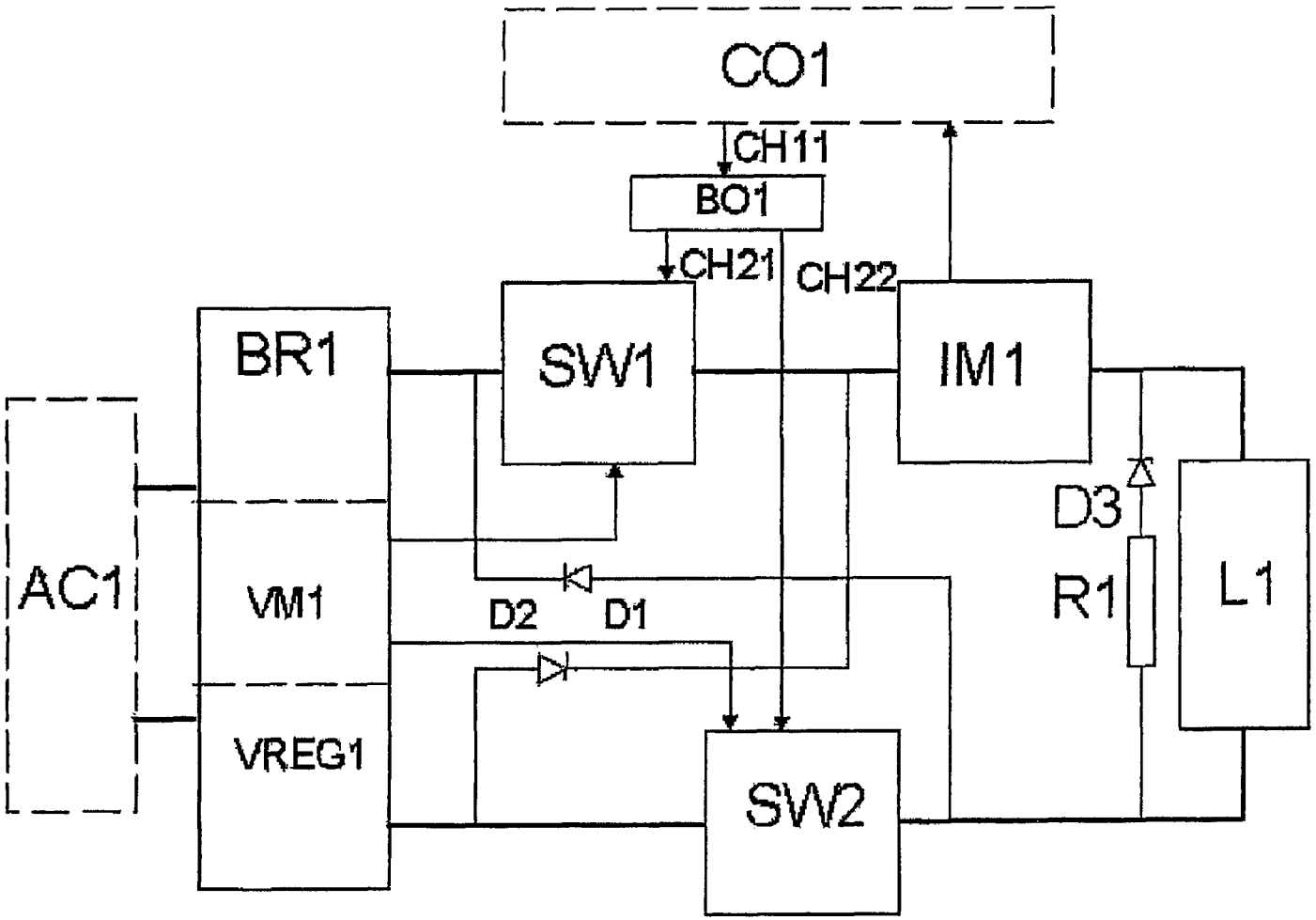
FIG. 2 presents a second brake control circuit according to the invention for controlling the brake of an elevator

FIG. 2 presents a control circuit that can be used in situations where only one channel CH11 leads out of the electric drive control unit. If only one channel CH11 leads out of the electric drive control unit (FIG. 2), then the control of the switches SW1 and SW2 can be implemented by dividing the control function between two different control circuits CH21 and CH22 in a separate brake controller BO1. The control circuit works on the same principle as the circuit presented in FIG. 1.

Figure 3:
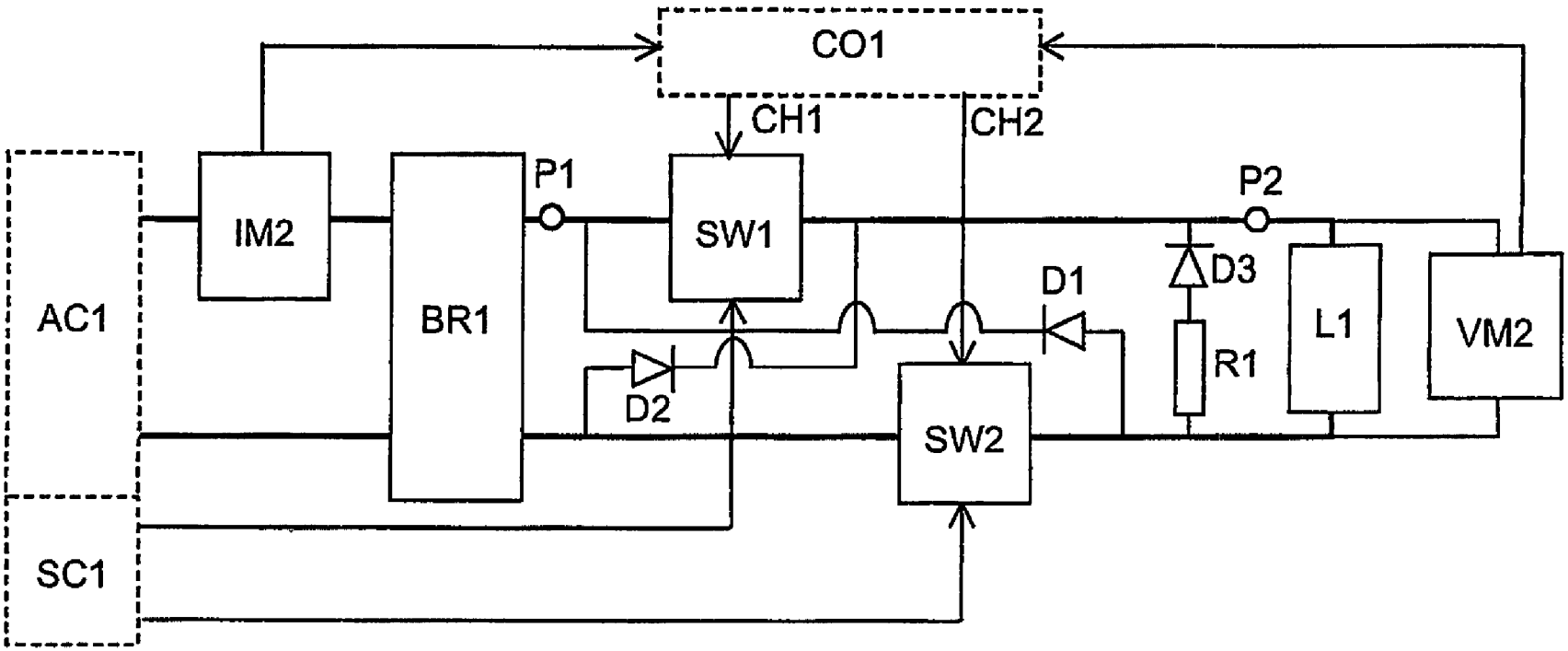
FIG. 3 presents a third brake control circuit according to the invention for controlling the brake of an elevator

FIG. 3 presents a control circuit according to the invention wherein the alternating-current network AC1, rectifier bridge BR1, semiconductor switches SW1 and SW2, control unit CO1 with control channels CH1 and CH2, flywheel diodes D1 and D2, resistor R1 and diode D3 as well as the brake coil L1 are disposed as in FIGS. 1 and 2. A current measuring unit IM2 is placed on the side of the alternating-voltage network, so it measures the current of alternating-current circuit feeding the direct-current circuit. The current measuring unit can also be placed in other ways in the circuit than in the ways illustrated in FIGS. 1-3, and the circuit may have more than one current measurement point. In addition, various voltages may be measured from the circuit. FIG. 3 shows two points P1 and P2 as examples of alternative locations of the current measurement point. If placed at point P2, the current measuring unit measures the current flowing through the brake coil even when the current is generated by the energy stored in the coil inductance and the current is flowing through resistor R1 and diode D3. In addition, FIG. 3 shows a voltage measuring unit VM2 arranged to measure the voltage across the brake coil. The voltage data produced by the unit can be passed to the control unit and used as a basis on which the state of the brake coil prevailing at each instant can also be determined. FIG. 3 additionally shows a safety circuit SC1, which may comprise as a part of it the alternating-current network AC1 feeding the rectifier bridge. The control of the switches SW1 and SW2 can be so arranged that an interruption of the safety circuit will lead to the opening of the switches.

Figure 4:
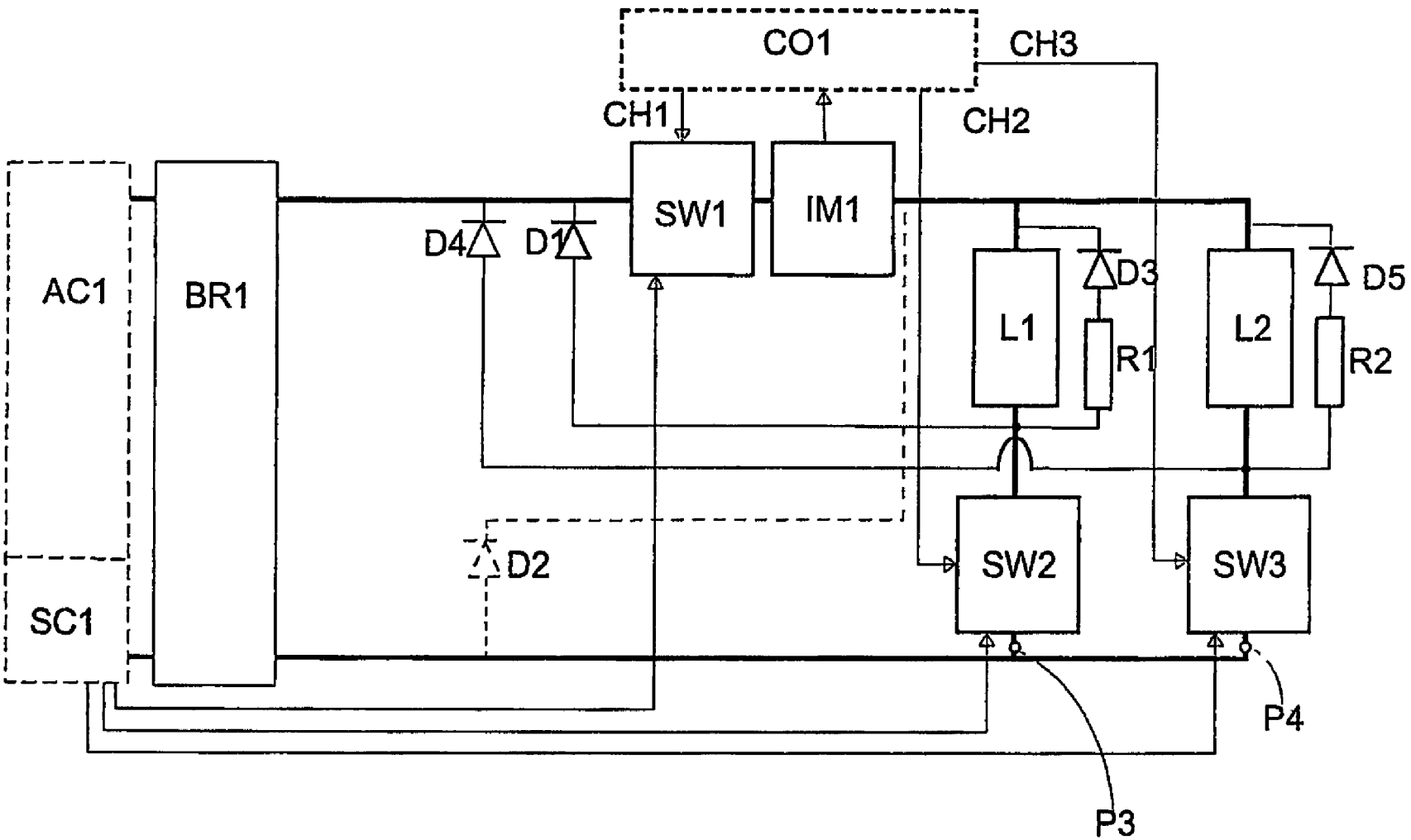
FIG. 4 presents a control circuit according to the invention wherein the same circuit is used for simultaneous control of two brakes.

FIG. 4 presents a control circuit according to the invention which is used to control two brakes simultaneously. The circuit comprises a branch consisting of a second brake coil L2, a series connection of a resistance R2 and a diode D5 connected in parallel with it and a switch SW3, said branch being connected in parallel with the circuit part consisting of brake coil L1, resistance R1, diode D3 and switch SW2. From a point between coil L2 and switch SW3, flywheel diode D4 provides a flow path for the current supplied by the inductance of coil L2 when switch SW3 is open, corresponding to the flow path provided by diode D1 for the current of coil L1. In the circuit in FIG. 4, the measurement of current has been arranged in such manner that the current measuring unit IM1 measures the current flowing through both brake coils. If the states of the brakes are to be monitored separately, then it is possible to provide a separate current measuring unit for each brake, from which units the current data can be passed to the control unit. These can be placed e.g. at points P3 and P4. Resistors R1 and R2 may have either equal or unequal resistance values, and in the latter case, in a fast stopping procedure, one of the brakes will work faster, the other more slowly.

The circuit presented in FIG. 4 can be used in such manner that that the current of the brake coils is only controlled by switches SW1 and SW3, in which case each brake can be controlled independently regardless of the control of the other brake. The condition of the switches SW2 and SW3 is monitored continuously, and the condition of switch SW1 is monitored when both brakes are in the closed state. If diode D2, depicted by a broken line in the figure, is also added to the circuit, then the current of the brake coil L1 can be controlled by switches SW1 and SW2 and the current of brake coil L2 by switches SW1 and SW3. Thus, all three switches are controlled alternately in such manner that the working condition of each switch can be checked via current measurement IM1 both when the brake is in the energized state and when it is in the de-energized state. Furthermore, the states of brakes can be chosen independently of each other, but the states of both brakes are taken into account in the control of the switches. The supply of current to each brake coil can be interrupted completely when necessary by means of the switch controlling the current of one of the coils, e.g. when the other switch is damaged.

It is obvious to the person skilled in the art that different embodiments of the invention are not limited to the embodiments described above by way of example, but that many variations and applications of the invention are possible within the scope of the inventive concept defined in the claims below.

The invention claimed is:

1. A control circuit for controlling an electromechanical elevator brake, said control circuit comprising:

at least one brake coil;

a direct-voltage source;

a semiconductor switch arrangement including at least two semiconductor switches;

a control unit; and a current measuring unit that produces current data passed to the control unit;

wherein the control unit alternately operates the at least two semiconductor switches such that the working condition of each switch can be checked in its turn on the basis of feedback data obtained from the current measuring unit.

2. A control circuit according to claim 1, wherein the supply of current to the at least one brake coil can be completely interrupted by means of one semiconductor switch connected to the direct-current circuit.

3. A control circuit according to claim 1 or 2, wherein the current flowing through the at least one brake coil is measured by the current measuring unit.

4. A control circuit according to claim 1, wherein the direct-voltage source is a rectifier bridge, and the current in the alternating-current network feeding the direct-voltage bridge is measured by the current measuring unit.

5. A control circuit according to claim 1, wherein the working condition of the semiconductor switches monitored on the basis of current measurement data obtained both when the brake is in a released state and when the brake is in a closed state.

6. A control circuit according to claim 1, further comprising: a voltage measuring unit arranged in parallel with the at least one brake coil and producing data that is passed to the control unit.

7. A control circuit according to claim 1, wherein the state of the brake is continuously determined on the basis of measurement data obtained from the control circuit.

8. A control circuit according to claim 1, wherein the semiconductor switches open when a safety circuit of the elevator is interrupted.

9. A control circuit according to claim 1, further comprising: a voltage measuring unit that produces voltage data used to control the semiconductor switches.

10. A control circuit according to claim 1, wherein the brake is closed at two different speeds.

11. A control circuit according to claim 1, further comprising: flywheel diodes through which current, fed by the brake coil inductance, flows when one of the semiconductor switches is in the conducting state.

12. An electromechanical elevator brake, comprising:

at least one brake coils;

a pressure element;

a brake pad pressed towards a braking surface by the pressure element, said brake pad being movable by the action of the force effects of a magnetic field set up by a current flowing in the brake coil; and a brake control circuit that controls the current supplied to the brake coil, the brake control circuit including at least one brake coil;

a direct-voltage source;

a semiconductor switch arrangement including at least two semiconductor switches;

a control unit; and a current measuring unit that produces current data passed to the control unit;

wherein the control unit alternately operates the at least two semiconductor switches, such that the working condition of each switch can be checked in its turn on the basis of feedback data obtained from the current measuring unit.

* * * * *